US006224443B1

(12) United States Patent
Mehrmann et al.

(10) Patent No.: US 6,224,443 B1
(45) Date of Patent: May 1, 2001

(54) MULTILAYER SWIM FIN AND METHOD

(75) Inventors: Charles Mehrmann, Bothell, WA (US); Scott Pekar, Dana Point, CA (US)

(73) Assignee: Earth & Ocean Sports, Inc., Redmond, WA (US)

( * ) Notice: Subject to any disclaimer, the term of this patent is extended or adjusted under 35 U.S.C. 154(b) by 0 days.

(21) Appl. No.: 09/523,324

(22) Filed: Mar. 10, 2000

(51) Int. Cl.[7] ..... A63B 31/08

(52) U.S. Cl. ..... 441/64

(58) Field of Search ..... 441/61–64

(56) References Cited

FOREIGN PATENT DOCUMENTS

063179 * 3/1994 (JP) ..... 441/64

* cited by examiner

*Primary Examiner*—Jesus D. Sotelo
(74) *Attorney, Agent, or Firm*—Richard P. Crowley

(57) ABSTRACT

A swim fin having a foot section with a foot cavity, a soft rubber foot pocket, and a blade section composed of blended cured layers of rubber sheet materials of selected durometer hardness. The swim fin is prepared by placing layers of sheet materials of different durometer hardness about a foot last and compression and heat molding the layers to form a molded, multiple layered, integral swim fin of selected durometer hardness.

22 Claims, 4 Drawing Sheets

MULTILAYER SWIM FIN AND METHOD

BACKGROUND OF THE INVENTION

Swim fins used by swimmers, body surfers, divers, and others in water are artificial fins, typically, of material like a resilient molded rubber or thermoplastic material, like ethylene-vinyl acetate (EVA), to improve propulsion speed and water agility. Swim fins may be prepared of synthetic materials, but one existing practice in the swim fin industry is to employ a swim fin having differential stiffness characteristics.

U.S. Pat. No. 5,290,194, issued Mar. 1, 1994, hereby incorporated by reference, discloses a swim fin which includes shoe and blade portions divided into longitudinal plural regions, each region representing an area of the fin formed from a particular material and of predetermined durometer range, so that the instep and toe region have different stiffness properties.

European Patent No. 0 436 927, published Jul. 17, 1991, as well as an improvement U.S. Pat. No. 5,435,764, issued Jul. 25, 1995, discloses a swim fin with a composite, partially multilayered blade section with a separate soft shoe section and an attached blade section composed of a base layer of a fairly rigid thermoplastic material, like ethylene-vinyl acetate (EVA) and a partial or full outer or top layer of a more resilient material, like a soft thermoplastic rubber.

It is desirable to provide a new and improved multilayered swim fin of controlled and selected durometer hardness and method of manufacture of such swim fins.

SUMMARY OF THE INVENTION

The invention relates to a swim fin and method of manufacture. In particular, the invention concerns a multilayer swim fin composed of layered materials of different durometer hardness, to improve swim fin performance, comfort, and appearance.

The invention comprises a swim fin having a foot section with a foot cavity, an extended blade section having a one and other end, and a base surface and a top surface. The blade section of the swim fin is designed for propulsion of the swimmer. The swim fin comprises a blade section which longitudinally increases in durometer hardness from the foot section to the other end of the blade section and generally perpendicularly from the base surface to the top surface. The swim fin comprises a plurality of overlapping, bonded, blade section layers of sheet materials of different durometer hardness.

The method of manufacture of the swim fin comprises a method of preparing an integral, molded swim fin having a foot section with a foot cavity and an extended blade section.

It has been discovered that a swim fin composed of longitudinal layers of materials of different durometer hardness (e.g., 20 to 120 durometers) and optionally, different durometer hardness perpendicularly, e.g., 20 to 120 durometers, as opposed to the prior art practice of defined differential stiffness regions along the longitudinal axis and perpendicular axis, provides a swim fin with a smooth, controlled flex or curve to the blade section as pressure is applied along the flutter-kick motion by a user. The integral molded swim fin with integral shoe and blade sections, as constructed and used, results in more powerful and smoother kick properties.

The layering of hard and soft rubber or elastomeric materials, to include thermoplastic materials, as well as curable materials, rather than the use of defined longitudinal regions of different stiffness and covered rigid blade sections, creates a swim fin with a more comfortable swim fin foot pocket, for example, of soft rubber or other material, with or without a fabric liner material with durometer hardness below 30, and yet provides a strong foot pocket and an integral, extended blade section, due to the layering effect of the materials from the one to the other end of the swim fin.

In addition, it has been discovered that layering the materials to form the swim fin also provides the opportunity for the creation of a design section or different colored (e.g., manufacturer) logos or other designs in the swim fin body. Typically, the layering of the rubber strap materials enables the top area of the swim fin forward of the foot pocket and toward the other end to be molded, not only of a different colored rubber, but of rubber of different, typically greater durometer hardness, e.g., 80 to 100 durometers.

The invention permits forming a soft foot pocket on a last from a moldable material, like soft gum rubber, and then blending-molding the foot pocket into the foot cavity of the swim fin.

The swim fin of the invention and the method of manufacture overcome some of the disadvantages of the prior art swim fin and manufacture techniques. Prior art multiple stiffness swim fins with selection regions tend to change properties abruptly in each region, while the swim fin of the invention provides the advantage of resiliency and flexibility, particularly and gradually along the blade section, where overlapping, multiple material layers are used in the body of the blade section extending from the foot section.

The swim fin of the invention, which may be symmetrical or asymmetrical in shape, provides a comfortable foot pocket which is molded and integral within the foot cavity section. The swim fin provides for a gradual, selected change in durometer hardness from the one to the other end of the swim fin and also perpendicular to the axis of the swim fin, by the use of layered materials.

The swim fin may vary in design and in materials used, but generally is formed of a solid or foam-moldable material, like a rubber or other elastomeric material, like a urethane elastomer, which materials may contain various fillers; stiffeners; additives; curing agents; fibers; modifiers; and other materials to provide selected properties, as required.

The materials used may vary in density, which usually varies with durometer hardness. The layers of materials used may vary in thickness; material; construction, e.g., solid or foam; and length and width. Generally, the layers include two or more layers which are of different hardness and will be stacked and at least partially overlap at the ends with other layers, so that there is no sharp break in the stiffness properties between the longitudinal axis regions. This layering provides, optionally, for a selected variation in durometer hardness in a direction perpendicular to the longitudinal axis, for example, a soft pocket outwardly to a harder external material and a soft internal material within the blade section end adjoining the foot section and a hard external material, while the blade section tip is typically composed of a single durometer material.

The swim fin is prepared by placing a plurality of selected separate layers of elastomeric or curable sheet materials, the same material or different materials, on a swim fin shoe last or shoe-blade last and then compression molding, under heat and pressure, the layers together in a mold, in a molding operation, to produce a molded, unitary, integral-formed swim fin.

The swim fin employs layers of sheet materials, e.g., 10 to 300 mils in thickness, such as 50 to 200 mils, to form a swim fin of selected design with a foot section and foot cavity and a blade section with a propulsion fin. Optionally, side reinforcing ribs, blow or drain holes, or other features may be formed or molded into the swim fin, and the trailing fin edge may be formed and shaped, as desired.

The sheet materials comprise thermoformable or curable moldable sheet materials of the same or different but compatible sheet materials, which on molding or blending are bonded or cured together to form a unitary fin. Optionally, but preferably, the foot cavity should have a fabric lining or have inserted a fabric to provide an integral, in-situ, soft foot pocket for foot comfort. The layers of sheet materials may be selected of different shapes, lengths, and thicknesses, and importantly, of varying durometer hardness, so that the application of overlapping layers of a selected sheet material, e.g., a heat-curable rubber, provides a swim fin with varying durometer hardness, but with no sharply defined regions of durometer hardness, which would lead to abrupt changes in blade section flex properties.

The selection of the layers of sheet material hardness and thickness together with the shape, for example, a blade section of generally trapezoidal or fin-like shape, permits control of the hardness properties in selected regions, like a gradual increase in durometer hardness in the blade section from the foot section to the other end of the blade section of 50–60 to 80–90 durometer, without abrupt changes, to provide a smooth responsive curve of the fin in use.

Rib-like sections of sheet material may be used on the sides of the swim fin to impart greater hardness to the side section, in place of, or to enhance the rib structure of the blade section. While the differences in durometer hardness are based on the cured molded rubber, and illustrated with different cross-hatching in the drawings, the unitary molded swim fin will not visually show such layers of material which will be blended, molded, formed, or cured together in the molding process. While various durometer hardnesses are illustrated, it is recognized that the hardness and the material may vary, as desired, to provide a swim fin having variation in hardness extending both longitudinally from the foot section to the other end of the blade section, as well as laterally and also perpendicular to the longitudinal axis.

The material suitable for use as the sheet material may vary, and typically, comprises polymeric material which may be thermoformed or molded to form an integral swim fin. Such polymeric materials may be selected for durometer hardness properties, as well as other properties, and should be compatible when molded or formed with different materials or the same material, but of different density, i.e., foam or solid, to secure, thermo bond, or cure the layers of sheet material together. While thermoforming and molding are the preferred methods of preparation, it is recognized, where applicable, that the plurality of layers of selected durometer hardness sheet materials may be bonded together with thin layers of compatible polymer or adhesive materials, rather than thermoforming or curing the sheet material. The swim fin may be composed of thermoplastic polymers, or preferably, of thermosetting polymers and rubber.

Suitable polymeric materials include natural and synthetic elastomeric materials subject to cure or polymerization, such as: natural rubber; styrene-butadiene rubber; ethylene-propylene rubber (EPR); ethylene-propylene terpolymer (EPDM); neoprene rubber; butyl rubber; urethane rubber and the like; and blends thereof. other polymers include vinyl and covinyl polymers, such as: ethylene vinyl acetate; polyvinyl chloride (PVC); polyurethanes; ethylene propylene polymers, copolymers, terpolymers and the like; and blends thereof. The polymer may include one or more metallocene polymers prepared by the use of a metallocene catalyst. The layers of material may be composed of all solid sheets, high density foam sheets, or any combination or arrangement thereof. The durometer hardness may be derived from the polymer per se or by selected additives to a treatment of the polymer.

Thus, the swim fin and method avoids regions of segmented hardness and the use of the layered method provides gradual changes in hardness in any area of the molded swim fin.

The invention will be described for the purpose of illustration only in connection with certain illustrated embodiments; however, it is recognized that various changes, modifications, additions and improvements may be made in the illustrative embodiments without departing from the spirit or scope of the invention.

DESCRIPTION OF THE EMBODIMENTS

Figure 1A:
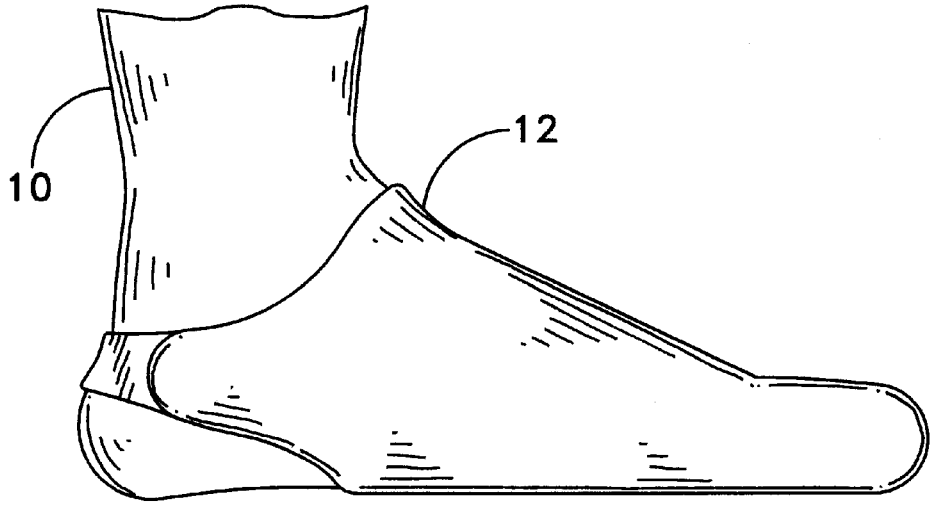
FIGS. 1A and B show a side plan view, FIG. 1A, and a top plan view.
Figure 1B:
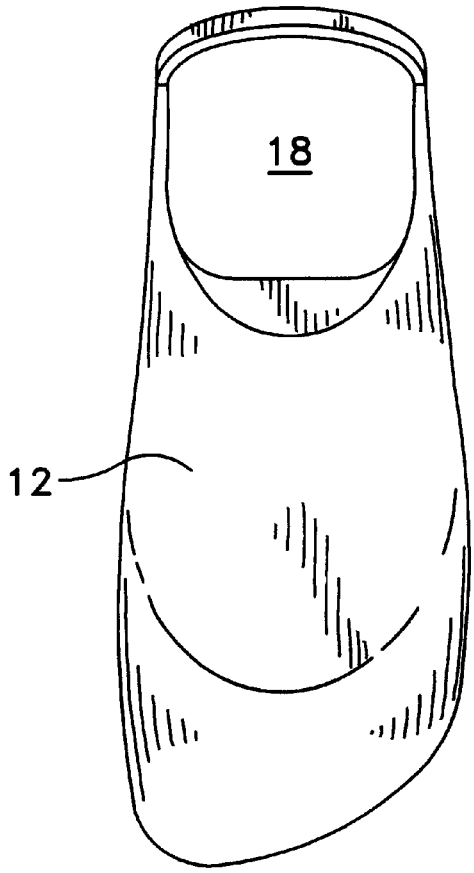
FIG. 1B, of a soft foot pocket, on a foot last, used in the swim fin of the invention.

FIGS. 1A and B show a foot last 10 covered with a soft gum rubber, such as by spraying or dipping the foot last with a gum rubber solution to form a soft gum rubber foot or sock pocket covering 12, for example, of about 10 to 100 mils thickness and of about 10 to 30 durometer hardness. The last covering, in place of or in addition to the rubber, may be formed of other polymeric materials, like EVA or rubber; a foam material; or an EVA or rubber-coated fabric, to form a single or multiple layered, soft foot pocket on the last. The material used for the foot pocket should be the same material or at least capable of being blended, molded, or bonded integrally with and into the sheet materials used to form the layered swim fin.

Figure 2:
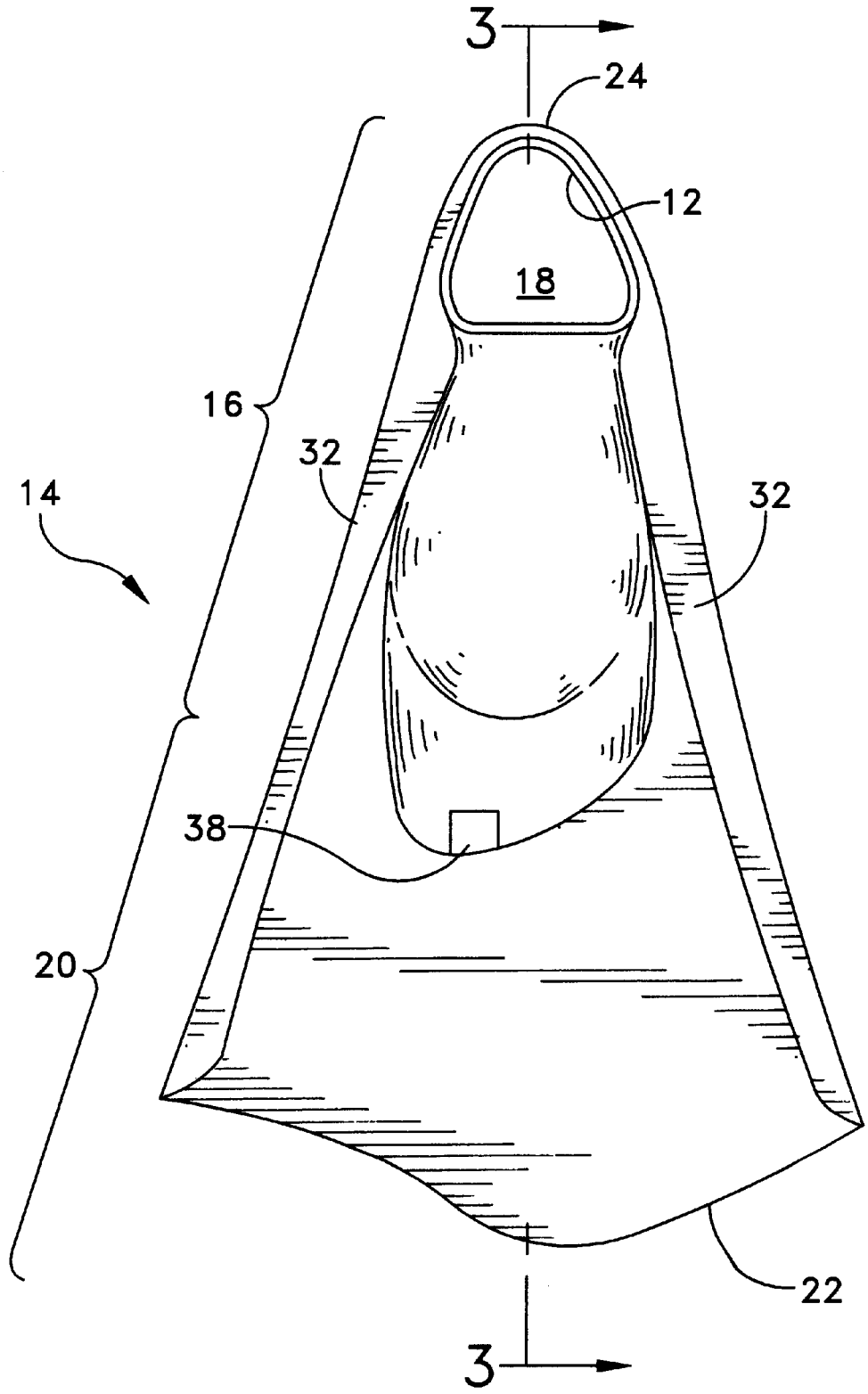
FIG. 2 is a top plan view of the swim fin of the invention.

FIG. 2 is a top plan view of a multiple layered, molded swim fin 14 of the invention, which has a foot section 16 and an integral, molded blade section 20 with a thin, generally curved blade end 22. The swim fin 14 has a flexible heel strap 24 (which may be an adjustable strap or heel pocket), a foot cavity 18 with an inner lining of soft gum rubber 12 (or woven or knit fabric with a soft bondable backing material), side support ribs 32, and a downward, tapered, rounded, foot-like top section over the foot cavity 18, formed of a plurality of overlapping, molded, different durometer sheet materials, for example, a cured blend of natural rubber and EPDM, varying to produce different hardness, and an open blow hole 38 to the foot cavity 18.

Figure 3:
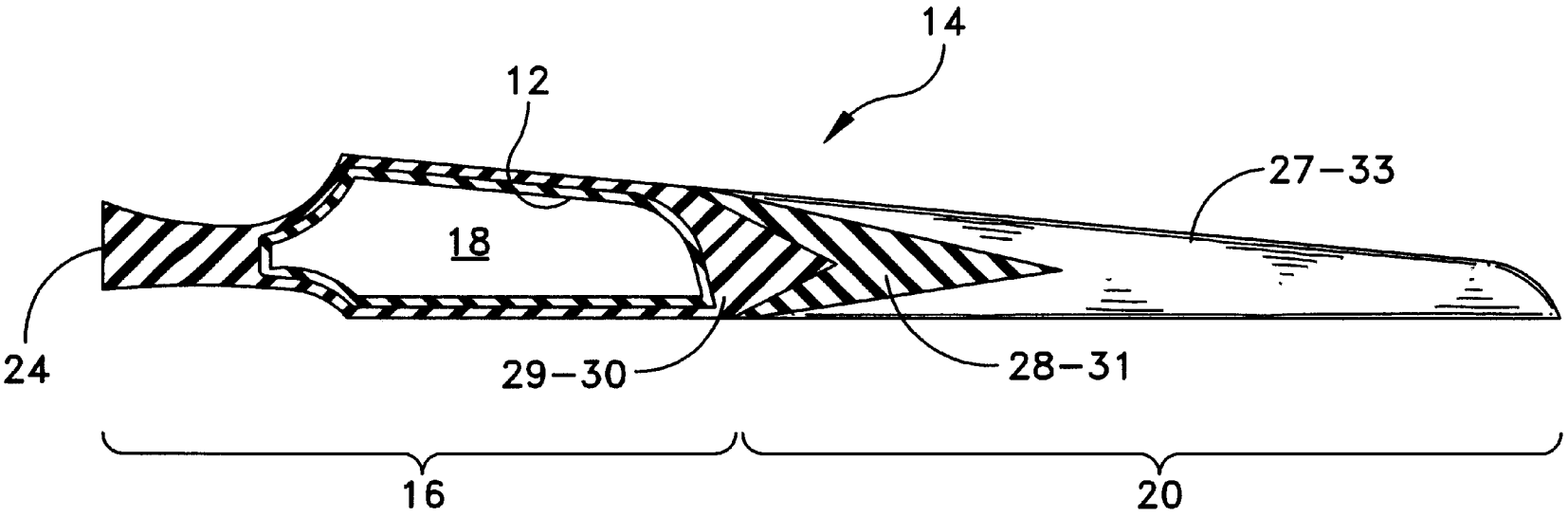
FIG. 3 is a longitudinal, central cross-sectional view of a multiple layer swim fin of the invention as shown along line 3—3 FIG. 2.

FIG. 3 illustrates, in a sectional view, the multiple tapered bonded layers of sheet materials molded and cured together to form the swim fin of FIG. 2. The plurality of layers of the cured (in the mold) sheet materials are of selected and at least 2 to 4 of different durometer hardness (see FIG. 4). The layers are arranged, overlapped, and bonded together in a closed molding operation, so that the durometer hardness longitudinally extends gradually from about 40 to 50 durometers at the heel strap 24 to about 80 to 90 durometers at the single layer, tapered blade end 22, while the durometer hardness also varies generally perpendicular to the longitudinal axis in the blade section 20 from about 80 to 90 durometers at the top and bottom to about 40 to 50 durometers in the intermediate or control section.

While FIG. 3 shows the layers as separate layers, such layers may not be visible to a user and are for the purpose of illustration only. The material, thickness, and hardness of each layer may vary, e.g., 5 to 10; however, as illustrated, the layers of elastomeric rubber material comprise: side rib 32 of 80 to 90 durometers; layer 27 of 80 to 90 durometers; layer 28 of 50 to 60 durometers; layer 29 of 40 to 50 durometers; layer 30 of 40 to 50 durometers; layer 31 of 50 to 60 durometers; layer 33 of 80 to 90 durometers; and side rib 32 of 80 to 90 durometers. Typically, the number of layers may vary, for example, from 3 to 12 layers, and the layers range in thickness from about 10 to 250 mils, e.g., 15 to 150 mils.

Figure 4:
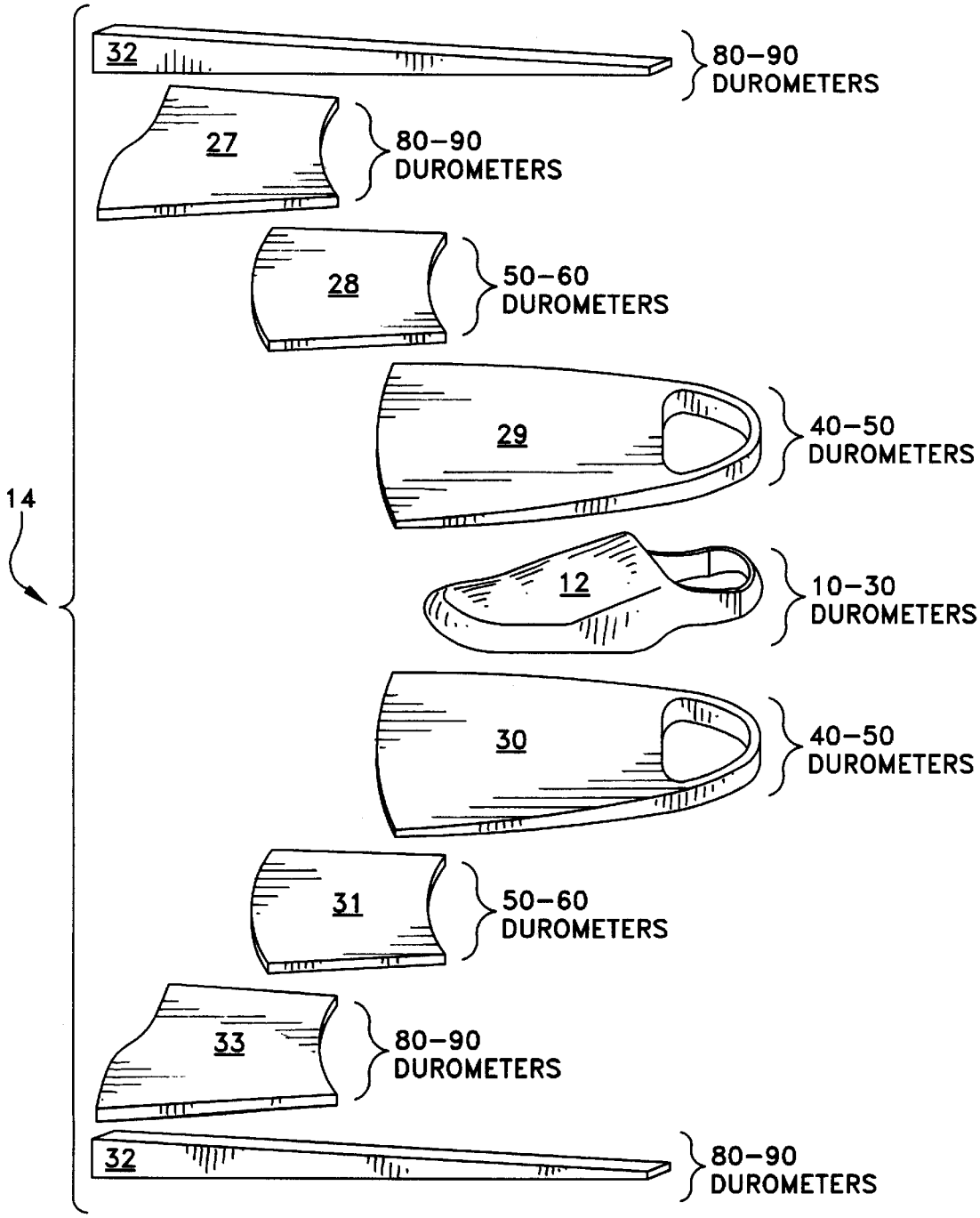
FIG. 4 is a schematic exploded view of the layer materials used to prepare the molded swim fin of FIG. 2.

FIG. 4 is an exploded view of the layers of uncured or molded sheet materials used, which are assembled about the soft pocket 12 on the last 10 and then placed in an enclosed mold under sufficient heat and pressure required to mold, cure, or otherwise form the integral swim fin of the invention characterized by; the selected variation in durometer hardness in various longitudinal, lateral, and perpendicular planes of the swim fin. As illustrated, the various layers of sheet materials, as assembled, may vary in shape and form with the intermediate layers less in length than the top and bottom layers, to form a generally uniform, tapered blade section, which angles uniformly downward to the blade section end. As shown, layers 29 and 30; 28 and 31; 27 and 33; and side ribs 32 are of the same shape, thickness, and durometer hardness to form a uniform, tapered, single end blade section.

If desired, the top external blade section or layer may be embossed, printed, or otherwise treated to bear a company logo, trademark, name, or other insignia, particularly where the top layer comprises a metallocene-type rubber, which permits the use of contrasting visible colors on the external surface.

It is recognized and a part of the invention that the layers of polymeric sheet materials assembled and stacked to prepare the swim fin may be composed of different compatible materials and be of different colors for design and identification purposes. Also, the assembled layers of sheet materials may include one or more intervening layers of other materials, such as mesh and scrim materials, like polypropylene; polyester; or fiberglass, as well as nonwoven and woven porous fabrics to impart adhesive bonding and strengthening of full or partial layers in the swim fin.

The employment of selected bondable layers permits the variation, as desired, of density, durometer hardness, and other properties in selected areas and along different planes of the swim fin and permits a variation in properties of the blade section of the swim fin to meet different uses and conditions.

What is claimed is:

1. A swim fin having a foot section with a foot cavity and an extended blade section having a one and other end and a base surface and a top surface, the blade section designed for propulsion of the swimmer, which swim fin comprises a blade section which longitudinally gradually increases in durometer hardness from the foot section to the other end of the blade section, and which blade section comprises a plurality of overlapping, bonded blade section layers of polymeric sheet materials of different and selected durometer hardness.

2. The swim fin of claim 1 wherein the material comprises a rubber material, and the swim fin comprises a molded integral swim fin.

3. The swim fin of claim 1 wherein the blade section has an outside layer on top and bottom of about 80 to 90 durometer hardness.

4. The swim fin of claim 3 wherein an inside layer of the blade section has a durometer hardness of about 40 to 60.

5. The swim fin of claim 3 wherein the other end of the blade section comprises a single durometer hardness of about 80 to 90.

6. The swim fin of claim 1 wherein the blade section, toward the foot section, comprises three layers of variable durometer hardness of about 40 to 90.

7. The swim fin of claim 1 wherein the foot section has a durometer hardness of about less than 50.

8. The swim fin of claim 1 which includes a soft foot pocket integral in the foot cavity, having a durometer hardness of about 20 to 30 or less.

9. The swim fin of claim 8 wherein the soft foot pocket comprises a pocket shaped to mold snugly in the foot cavity, and the material is selected from the group consisting of: rubber; foam; and rubber-covered or foam-covered cloth material.

10. The swim fin of claim 1 which includes, on the top, a raised logo formed of a different color than the top of the swim fin.

11. The swim fin of claim 1 having a foot section substantially composed of and formed of a material of less than 50 durometer hardness, and the blade section includes layers to form top and bottom tapered sections extending toward the other end from the foot section and of selected increased durometer hardness toward the other end.

12. The swim fin of claim 1 wherein the durometer hardness along the perpendicular axis increases from the center of the blade thickness and extends to the top or bottom surface or both surfaces.

13. The swim fin of claim 1 wherein the polymeric sheet material comprises cured elastomeric blends of natural rubber and ethylene-propylene rubber (EPR) materials.

14. The swim fin of claim 1 wherein the blade section comprises from about 5 to 10 layers of overlapping, polymeric sheet materials ranging in thickness from about 10 to 300 mils.

15. The swim fin of claim 14 wherein the durometer hardness of the sheet materials range from about 40 to 90 durometers.

16. An integral, molded, multiple layer swim fin which comprises:

a) a swim fin having a top and a bottom, a longitudinal axis, and a foot section at one end, with a foot cavity and a blade section for propulsion extending from the foot section to the other end;

b) the swim fin comprising a plurality of and at least two contiguous, generally longitudinal, overlapping layers of polymeric materials of selected, differential durometer hardness, with an internal layer of less durometer hardness than an external layer, to provide a swim fin of selected, overlapping, increased durometer hardness from the one end to the other end.

17. A method of manufacture of an integral, formed, multilayer swim fin, which method comprises:

a) providing a swim fin last to form a swim fin with a foot section with a foot cavity at one end and a blade section at the other end;

b) covering the swim fin last along a longitudinal axis with a soft material to form a foot pocket for the swim fin on the last;

c) covering the formed, soft foot pocket with multiple overlapping selected layers along the longitudinal axis of moldable material of different durometer hardness to form the blade section of the swim fin;

d) molding the materials on and about the last to form a molded, unitary swim fin characterized by cured multiple layers of polymeric material and of differential durometer hardness.

18. The method of claim 17 wherein the foot pocket is selected from the group consisting of a pocket shaped to mold snugly in the foot cavity, and the material is selected from the group consisting of: rubber; foam; and rubber-covered or foam-covered cloth material.

19. The method of claim 17 which includes forming a logo design on the top of the swim fin of a different color and greater durometer hardness than the underlying molded material.

20. The method of claim 17 wherein the moldable material comprises a moldable, curable, rubber layer material with durometer hardness after molding and curing of from about 20 to 90 durometers.

21. The swim fin prepared by the method of claim 17.

22. A method of preparing an integral, molded swim fin having a foot section with a foot cavity and an extended blade section, which method comprises molding a swim fin under compression and heat in a mold, with the swim fin formed of a plurality of overlapping longitudinal layers of moldable, selected, uncured rubber sheet materials, the sheet materials of selected durometer hardness, to provide a swim fin having a blade section with different durometer hardness layers.

* * * * *